US012365843B2

(12) United States Patent
Weiss et al.

(10) Patent No.: US 12,365,843 B2
(45) **Date of Patent: *Jul. 22, 2025**

(54) OPTIMIZED METHOD FOR PROCESSING PLASTIC PYROLYSIS OILS FOR IMPROVING THEIR USE

(71) Applicant: IFP Energies Nouvelles, Rueil-Malmaison (FR)

(72) Inventors: Wilfried Weiss, Rueil-Malmaison (FR); Jerome Bonnardot, Rueil-Malmaison (FR)

(73) Assignee: IFP Energies Nouvelles, Rueil-Malmaison (FR)

( * ) Notice: Subject to any disclaimer, the term of this patent is extended or adjusted under 35 U.S.C. 154(b) by 148 days.

This patent is subject to a terminal disclaimer.

(21) Appl. No.: 17/792,456

(22) PCT Filed: Feb. 15, 2021

(86) PCT No.: PCT/EP2021/053587
§ 371 (c)(1),
(2) Date: Jul. 13, 2022

(87) PCT Pub. No.: WO2021/165178
PCT Pub. Date: Aug. 26, 2021

(65) Prior Publication Data

US 2023/0029587 A1 Feb. 2, 2023

(30) Foreign Application Priority Data

Feb. 21, 2020 (FR) ..... 2001758

(51) Int. Cl.
*C10G 65/06* (2006.01)
*C10G 1/00* (2006.01)
(Continued)

(52) U.S. Cl.
CPC ..... *C10G 65/06* (2013.01); *C10G 1/002* (2013.01); *C10G 1/10* (2013.01); *C10G 69/06* (2013.01);
(Continued)

(58) Field of Classification Search
None
See application file for complete search history.

(56) References Cited

U.S. PATENT DOCUMENTS 3,492,220 A * 1/1970 Lempert ..... C10G 45/36 208/210
5,068,484 A * 11/1991 James, Jr. ..... C10G 65/06 585/641
(Continued)

FOREIGN PATENT DOCUMENTS

FR 3012467 A1 5/2015
JP H0985046 A * 3/1997 ..... Y02W 30/62
WO WO-2014001632 A1 * 1/2014 ..... C10B 53/02

OTHER PUBLICATIONS

Machine translation JP H0985046. retrieved Jan. 24, 2024 (Year: 2024).*
(Continued)

*Primary Examiner* — Bobby Ramdhanie
*Assistant Examiner* — Alyssa L Cepluch

(57) ABSTRACT

A process for treating plastics pyrolysis oil by
a) selectively hydrogenating a feedstock in the presence hydrogen and a selective hydrogenation catalyst, at a temperature between 100 and 150° C., a hydrogen partial pressure between 1.0 and 10.0 MPa abs. and an hourly space velocity between 1.0 and 10.0 $h^{-1}$, to obtain a hydrogenated effluent;
b) hydrotreating the hydrogenated effluent in the presence of hydrogen and a hydrotreating catalyst, at a temperature between 250 and 370° C., a hydrogen partial pressure
(Continued)

Figure 1:
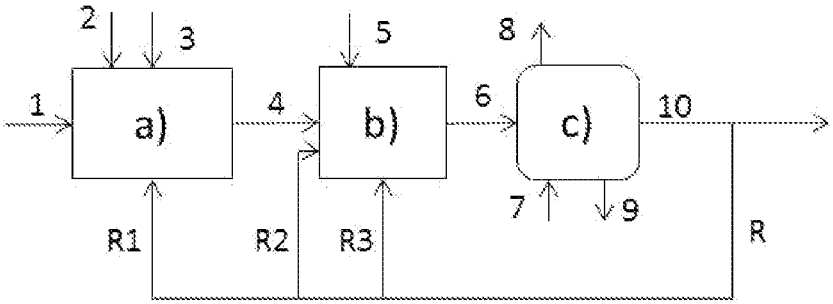

between 1.0 and 10.0 MPa abs. and an hourly space velocity between 0.1 and 10.0 $h^{-1}$, to obtain a hydrotreating effluent;

c) separating the hydrotreating effluent in the presence of an aqueous stream, at a temperature between 50 and 370° C., to obtain at least one gaseous effluent, a liquid aqueous effluent and a liquid hydrocarbon effluent;

e) recycling at least one fraction of the product obtained.

20 Claims, 1 Drawing Sheet

(51) Int. Cl.
*C10G 1/10* (2006.01)
*C10G 69/06* (2006.01)

(52) U.S. Cl.
CPC ..... *C10G 2300/1003* (2013.01); *C10G 2300/202* (2013.01); *C10G 2300/205* (2013.01); *C10G 2300/206* (2013.01); *C10G 2300/301* (2013.01); *C10G 2300/308* (2013.01)

(56) References Cited

U.S. PATENT DOCUMENTS

| | | | | |
|---|---|---|---|---|
| 5,904,838 | A * | 5/1999 | Kalnes | C10G 65/04 208/143 |
| 2011/0139680 | A1 | 6/2011 | Fournier et al. | |
| 2011/0277377 | A1* | 11/2011 | Novak | C10L 1/026 44/435 |
| 2016/0002544 | A1* | 1/2016 | Sorensen, Jr. | C10G 45/32 585/24 |
| 2016/0264874 | A1* | 9/2016 | Narayanaswamy | C10G 1/10 |
| 2016/0264885 | A1 | 9/2016 | Narayanaswamy et al. | |
| 2017/0355914 | A1 | 12/2017 | Weiss et al. | |
| 2018/0155633 | A1* | 6/2018 | Al-Ghamdi | C10G 9/005 |
| 2019/0161683 | A1* | 5/2019 | Narayanaswamy | C10G 69/14 |

OTHER PUBLICATIONS

International Search Report dated May 3, 2021 issued in corresponding PCT/EP2021/053587 application (3 pages).

* cited by examiner

OPTIMIZED METHOD FOR PROCESSING PLASTIC PYROLYSIS OILS FOR IMPROVING THEIR USE

TECHNICAL FIELD

The present invention relates to a process for the treatment of a plastics pyrolysis oil in order to obtain a hydrocarbon effluent which can be upgraded, for example by being at least partly directly incorporated in a naphtha or diesel pool or as feedstock for a steam cracking unit. More particularly, the present invention relates to a process for the treatment of a feedstock resulting from the pyrolysis of plastic waste, in order to at least partly remove impurities, in particular olefins (monoolef ins and diolefins), metals, in particular silicon, and halogens, in particular chlorine, which said feedstock may contain in relatively large amounts, and so as to hydrogenate the feedstock in order to be able to upgrade it.

The process according to the invention thus makes it possible to treat plastics pyrolysis oils in order to obtain an effluent which can be injected, in all or part, into a steam cracking unit. The process according to the invention thus makes it possible to upgrade plastics pyrolysis oils, while reducing the formation of coke and thus the risks of plugging and/or of premature losses of activity of the catalyst(s) used in the steam cracking unit, and while reducing the corrosion risks.

PRIOR ART

Plastics obtained from collection and sorting channels may undergo a stage of pyrolysis in order to obtain, inter alia, pyrolysis oils. These plastics pyrolysis oils are generally incinerated to generate electricity and/or used as fuel in industrial or urban heating boilers.

Another route for upgrading plastics pyrolysis oils might be the use of these plastics pyrolysis oils as feedstock for a steam cracking unit in order to (re)create olefins, the latter being constituent monomers of certain polymers. However, plastic waste is generally mixtures of several polymers, for example mixtures of polyethylene, polypropylene, polyethylene terephthalate, polyvinyl chloride or polystyrene. Furthermore, depending on the uses, the plastics may contain, in addition to the polymers, other compounds, such as plasticizers, pigments, dyes or also polymerization catalyst residues. Plastic waste may also contain, in a minor amount, biomass originating, for example, from household waste. The result of this is that the oils resulting from the pyrolysis of plastic waste comprise a lot of impurities, in particular diolefins, metals, in particular silicon, or also halogenated compounds, in particular chlorine-based compounds, heteroelements, such as sulfur, oxygen and nitrogen, and insoluble materials, at contents which are often high and incompatible with steam cracking units or units located downstream of steam cracking units, in particular polymerization processes and selective hydrogenation processes. These impurities can give rise to operability problems and in particular problems of corrosion, of coking or of catalytic deactivation, or also incompatibility problems in the uses of the target polymers. The presence of diolefins can also result in problems of instability of the pyrolysis oil, characterized by the formation of gums. This phenomenon is generally limited by appropriate storage of the feedstock. The gums and the insoluble materials which may be present in pyrolysis oil can give rise to problems of clogging in the processes.

Furthermore, during the steam cracking stage, the yields of light olefins desired for the petrochemical industry, in particular ethylene and propylene, are strongly dependent on the quality of the feedstocks sent for steam cracking. The BMCI (Bureau of Mines Correlation Index) is often used to characterize hydrocarbon cuts. Overall, the yields of light olefins increase when the paraffin content increases and/or when the BMCI decreases. Conversely, the yields of undesired heavy compounds and/or of coke increase when the BMCI increases.

The document WO 2018/055555 proposes an overall process for the recycling of plastic waste which is very general and relatively complex, ranging from the very stage of pyrolysis of the plastic waste up to the steam cracking stage. The process of application WO 2018/055555 comprises, inter alia, a stage of hydrotreating the liquid phase resulting directly from the pyrolysis, preferably under quite stringent conditions, in particular in terms of temperature, for example at a temperature of between 260 and 300° C., a stage of separation of the hydrotreating effluent and then a stage of hydrodealkylation of the separated heavy effluent at a preferably high temperature, for example of between 260 and 400° C.

The present invention is targeted at overcoming these disadvantages and at participating in the recycling of plastics, by providing a process for the treatment of an oil resulting from the pyrolysis of plastics to purify it and to hydrotreat it in order to obtain a hydrocarbon effluent having a reduced content of impurities and thus upgradable, either directly in the form of naphtha cut and/or diesel cut, or exhibiting a composition compatible with a feedstock of a steam cracking unit and making it possible to obtain improved yields of light olefins during the steam cracking stage, while reducing in particular the risks of plugging during stages of treatment of plastics pyrolysis oils, such as those described in the prior art, and the formation of coke in large amounts and/or the risks of corrosion which are encountered during subsequent stage(s), for example during the stage of steam cracking of the plastics pyrolysis oils.

SUMMARY OF THE INVENTION

The invention relates to a process for the treatment of a feedstock comprising a plastics pyrolysis oil, comprising:

a) a stage of selective hydrogenation carried out in a reaction section fed at least with said feedstock and a gas stream comprising hydrogen, in the presence of at least one selective hydrogenation catalyst, at a temperature between 100 and 250° C., a hydrogen partial pressure between 1.0 and 10.0 MPa abs. and an hourly space velocity between 1.0 and 10.0 $h^{-1}$, to obtain a hydrogenated effluent;

b) a hydrotreating stage carried out in a hydrotreating reaction section, employing a fixed-bed reactor having n catalytic beds, n being an integer greater than or equal to 1, each comprising at least one hydrotreating catalyst, said hydrotreating reaction section being fed at least with said hydrogenated effluent resulting from stage a) and a gas stream comprising hydrogen, said hydrogenated effluent resulting from stage a) and said gas stream comprising hydrogen being introduced into the hydrotreating reaction section at the level of the first catalytic bed of said section, said hydrotreating reaction section being used at a temperature between 250 and 430° C., a hydrogen partial pressure between 1.0 and 10.0 MPa abs. and an hourly space velocity between 0.1 and 10.0 $h^{-1}$, to obtain a hydrotreating effluent;

c) a separation stage, fed with the hydrotreating effluent resulting from stage b) and an aqueous solution, said stage being operated at a temperature between 50 and 370° C., to obtain at least one gaseous effluent, an aqueous effluent and a hydrocarbon effluent;

d) optionally a stage of fractionating all or part of the hydrocarbon effluent resulting from stage c), to obtain at least one gas stream and at least one hydrocarbon stream;

e) a recycling stage comprising a phase of recovery of a fraction of the hydrocarbon effluent resulting from the separation stage c) or a fraction of the and/or of at least one of the hydrocarbon stream(s) resulting from the optional fractionation stage d), to constitute a recycle stream, and a phase of recycling said recycle stream to at least the selective hydrogenation stage a), the hydrotreating stage b) or stages a) and b).

One advantage of the process according to the invention is that of purifying an oil resulting from the pyrolysis of plastic waste of at least a part of its impurities, which makes it possible to hydrogenate it and thus to be able to upgrade it, in particular by incorporating it directly in a fuel pool or also by making it compatible with a treatment in a steam cracking unit, in order to be able in particular to obtain light olefins with increased yields which can be used as monomers in the manufacture of polymers.

Another advantage of the invention is that of preventing risks of plugging and/or corrosion of the treatment unit in which the process of the invention is carried out, the risks being exacerbated by the presence, often in large amounts, of diolefins, metals and halogenated compounds in the plastics pyrolysis oil.

The process of the invention thus makes it possible to obtain a hydrocarbon effluent resulting from a plastics pyrolysis oil which is at least partly freed from the impurities of the starting plastics pyrolysis oil, thus limiting the problems of operability, such as the problems of corrosion, of coking or of catalytic deactivation, to which these impurities may give rise, in particular in steam cracking units and/or in units located downstream of the steam cracking units, in particular the polymerization and selective hydrogenation units. The removal of at least a part of the impurities from the oils resulting from the pyrolysis of plastic waste will also make it possible to increase the range of applications of the target polymers, the incompatibilities of uses being reduced.

The invention has the further advantage of participating in the recycling of plastics and in the conservation of fossil resources, by making possible the upgrading of the oils resulting from their pyrolysis. This is because the invention makes possible the purification and the hydrotreating of these oils, which can then be introduced into a steam cracker to obtain olefins and thus to remanufacture polymers. The process also makes it possible to obtain naphtha and/or diesel cuts from feedstock comprising plastics pyrolysis oils, which cuts the refiner might directly integrate respectively in the naphtha pool and/or in the diesel pool which are obtained by refining crude oil.

DESCRIPTION OF THE EMBODIMENTS

According to the invention, a "plastics pyrolysis oil" is an oil, advantageously in liquid form at ambient temperature, resulting from the pyrolysis of plastics, preferably of plastic waste originating in particular from collection and sorting channels. It especially comprises a mixture of hydrocarbon compounds, in particular paraffins, monoolefins and/or diolefins, naphthenes and aromatics, these hydrocarbon compounds preferably having a boiling point of less than 700° C. and preferably of less than 550° C. The plastics pyrolysis oil can also comprise, and usually does comprise, impurities such as metals, in particular silicon and iron, and halogenated compounds, in particular chlorinated compounds. These impurities can be present in the plastics pyrolysis oil at high contents, for example up to 350 ppm by weight or also 700 ppm by weight, indeed even 1000 ppm by weight, of halogen elements contributed by halogenated compounds, and up to 100 ppm by weight, indeed even 200 ppm by weight, of metallic or semimetallic elements. Alkali metals, alkaline earth metals, transition metals, p-block metals and metalloids can be likened to contaminants of metallic nature, referred to as metals or metallic or semimetallic elements. In particular, the metals or metallic or semimetallic elements possibly contained in the oils resulting from the pyrolysis of plastic waste comprise silicon, iron or both these elements. The plastics pyrolysis oil can also comprise other impurities, such as heteroelements contributed in particular by sulfur compounds, oxygen compounds and/or nitrogen compounds, at contents generally of less than 10 000 ppm by weight of heteroelements and preferably of less than 4000 ppm by weight of heteroelements.

According to the present invention, the pressures are absolute pressures, also denoted abs., and are given in MPa absolute (or MPa abs.).

According to the present invention, the expressions "of between . . . and . . . " and "between . . . and . . . " are equivalent and mean that the limiting values of the interval are included in the range of values which is described. If such were not the case and if the limiting values were not included in the range described, such a clarification will be introduced by the present invention.

Within the meaning of the present invention, the various parameter ranges for a given stage, such as the pressure ranges and the temperature ranges, can be used alone or in combination. For example, within the meaning of the present invention, a range of preferred pressure values can be combined with a range of more preferred temperature values.

In the continuation, specific and/or preferred embodiments of the invention may be described. They can be implemented separately or combined together, without limitation of combination when this is technically feasible.

The invention relates to a process for the treatment of a feedstock comprising a plastics pyrolysis oil, comprising the following stages:

a) a selective hydrogenation stage advantageously carried out in a fixed bed in which the feedstock and hydrogen are brought into contact in the presence of at least one selective hydrogenation catalyst and optionally of at least one fraction of a recycle stream advantageously resulting from the optional stage e), said selective hydrogenation being carried out at a temperature between 100 and 250° C., preferably between 110 and 200° C., in a preferred way between 130 and 180° C., a hydrogen partial pressure between 1.0 and 10.0 MPa abs. and an hourly space velocity between 1.0 and 10.0 $h^{-1}$, advantageously in at least one reactor, preferably in at least two reactors and in a preferred way in two permutable reactors in series of PRS (Permutable Reactor System) type, to obtain at least one effluent with a reduced content of diolefins, also referred to as hydrogenated effluent;

b) a hydrotreating stage carried out in a fixed bed in which the hydrogenated effluent resulting from the selective hydrogenation stage a) is brought into contact with hydrogen in the presence of at least one hydrotreating catalyst and preferably at least one fraction of a recycle stream advantageously resulting from the optional stage e), said stage b) being carried out in at least one fixed-bed reactor, advantageously comprising n catalytic beds, n being an integer greater than or equal to 1, preferably of between 2 and 10, in a preferred way between 2 and 5, at a temperature between 250 and 430° C., preferably between 280 and 380° C., at a hydrogen partial pressure between 1.0 and 10.0 MPa abs. and at an hourly space velocity (HSV) between 0.1 and 10.0 $h^{-1}$, preferably between 0.1 and 5.0 $h^{-1}$, preferentially between 0.2 and 2.0 $h^{-1}$, in a preferred way between 0.2 and 0.8 $h^{-1}$, said hydrogen stream being advantageously introduced onto the first bed of the first reactor in operation, it being possible for an additional gas stream comprising hydrogen advantageously to be introduced at the inlet of each catalytic bed from the second catalytic bed and/or at the inlet of each of the other reactors operating in particular in series, to obtain at least one hydrotreating effluent;

c) a stage of separation of the hydrotreating effluent resulting from stage b), employing a washing/separation section fed with the hydrotreating effluent resulting from stage b) and advantageously an aqueous stream, said separation stage being carried out at a temperature of between 50 and 370° C., preferentially between 100 and 340° C., in a preferred way between 200 and 300° C., to obtain at least one gaseous effluent, an aqueous effluent and a hydrocarbon effluent;

d) optionally a stage of fractionating all or part, preferably all, of the hydrocarbon effluent resulting from stage c), to obtain at least one gas stream and at least one hydrocarbon stream;

e) optionally a stage of recycling a fraction of the hydrocarbon effluent resulting from the separation stage c) or a fraction of the or of at least one of the hydrocarbon stream(s) resulting from the optional fractionation stage d) to at least one of the reaction stages a) and/or b).

The Feedstock

The feedstock of the process according to the invention comprises at least one plastics pyrolysis oil. Said feedstock can consist solely of plastics pyrolysis oil(s). Preferably, said feedstock comprises at least 50% by weight, in a preferred way between 75% and 100% by weight, of plastics pyrolysis oil, that is to say preferably between 50% and 100% by weight and in a preferred way between 70% and 100% by weight of plastics pyrolysis oil. The feedstock of the process according to the invention can comprise, inter alia, one or more plastics pyrolysis oil(s), a conventional petroleum feedstock or a feedstock resulting from the conversion of biomass which is then cotreated with the plastics pyrolysis oil of the feedstock.

The plastics pyrolysis oil of said feedstock comprises hydrocarbon compounds and impurities such as in particular mono- and/or diolef ins, metals, in particular silicon and iron, halogenated compounds, in particular chlorinated compounds, and heteroelements contributed by sulfur compounds, oxygen compounds and/or nitrogen compounds. These impurities are often present at often high contents, for example up to 350 ppm by weight or also 700 ppm by weight, indeed even 1000 ppm by weight, of halogen elements contributed by halogenated compounds, and up to 100 ppm by weight, indeed even 200 ppm by weight, of metallic or semimetallic elements.

Said feedstock comprising a plastics pyrolysis oil can advantageously be pretreated in an optional pretreatment stage a0), prior to the selective hydrogenation stage a), to obtain a pretreated feedstock which feeds stage a). This optional pretreatment stage a0) makes it possible to reduce the amount of contaminants, in particular the amount of silicon, possibly present in the feedstock comprising a plastics pyrolysis oil. Thus, an optional stage a0) of pretreatment of the feedstock comprising a plastics pyrolysis oil is advantageously carried out in particular when said feedstock comprises more than 50 ppm by weight, in particular more than 20 ppm by weight, more particularly more than 10 ppm by weight, indeed even more than 5 ppm by weight, of metallic elements and especially when said feedstock comprises more than 20 ppm by weight of silicon, more particularly more than 10 ppm by weight, indeed even more than 5 ppm by weight and more particularly still more than 1.0 ppm by weight of silicon. Said optional pretreatment stage a0) can also comprise a filtration stage so as to remove possible solid impurities.

Said optional pretreatment stage a0) is carried out prior to the selective hydrogenation stage a) in an adsorption section operated in the presence of at least one adsorbent, preferably having a specific surface of greater than or equal to 100 $m^2/g$, and/or in a solid/liquid separation section, for example a filtration section. Said optional pretreatment stage a0) is fed with said feedstock comprising a plastics pyrolysis oil and is carried out at a temperature between 0 and 150° C., preferably between 5 and 100° C., and at a pressure between 0.15 and 10.0 MPa abs., preferably between 0.2 and 1.0 MPa abs. Preferably, said optional pretreatment stage a0) employs at least one adsorption section. The adsorption section is advantageously operated in the presence of at least one adsorbent, preferably of alumina type, having a specific surface of greater than or equal to 100 $m^2/g$, preferably of greater than or equal to 200 $m^2/g$. The specific surface of said at least one adsorbent is advantageously less than or equal to 600 $m^2/g$, in particular less than or equal to 400 $m^2/g$. The specific surface of the adsorbent is a surface area measured by the BET method, that is to say the specific surface determined by nitrogen adsorption in accordance with the standard ASTM D 3663-78 drawn up from the Brunauer-Emmett-Teller method described in the periodical *The Journal of the American Chemical Society,* 60, 309 (1938). Advantageously, said adsorbent comprises less than 1% by weight of metallic elements and preferably is devoid of metallic elements. Metallic elements of the adsorbent should be understood as meaning the elements of Groups 6 to 10 of the Periodic Table of the Elements.

Said adsorption section of the optional stage a0) comprises at least one adsorption column, preferably comprises at least two adsorption columns, preferentially between two and four adsorption columns, containing said adsorbent. When the adsorption section comprises two adsorption columns, one operating mode can be a "swing" operation, in which one of the columns is on-line, that is to say in operation, while the other column is in reserve. When the adsorbent of the on-line column is spent, this column is isolated, while the column in reserve is placed on-line, that is to say in operation. The spent adsorbent can subsequently be regenerated in situ and/or replaced with fresh adsorbent in order for the column containing it to be again able to be placed back on-line once the other column has been isolated.

Another operating mode is to have at least two columns operating in series. When the adsorbent of the column placed at the head is spent, this first column is isolated and the spent adsorbent is either regenerated in situ or replaced with fresh adsorbent. The column is subsequently brought back on-line in the last position, and so on. This operation is known as permutable mode, or according to the term PRS for Permutable Reactor System, or also "lead and lag". The combination of at least two adsorption columns makes it possible to overcome the possible and possibly rapid poisoning and/or clogging of the adsorbent due to the combined action of the metallic contaminants, of the diolef ins, of the gums obtained from the diolef ins and of the insoluble matter that may be present in the plastics pyrolysis oil to be treated. This is because the presence of at least two adsorption columns facilitates the replacement and/or the regeneration of the adsorbent, advantageously without shutdown of the pretreatment unit, indeed even of the process, thus making it possible to reduce the risks of clogging and thus to avoid shutdown of the unit due to clogging, to control the costs and to limit the consumption of adsorbent.

Said optional pretreatment stage a0) can also optionally be fed with at least one fraction of a recycle stream, advantageously resulting from stage e) of the process, as a mixture with or separately from the feedstock comprising a plastics pyrolysis oil.

Said optional pretreatment stage a0) thus makes it possible to obtain a pretreated feedstock which subsequently feeds the selective hydrogenation stage a).

Selective Hydrogenation Stage a)

According to the invention, the process comprises a stage a) of selective hydrogenation of the feedstock comprising a plastics pyrolysis oil carried out in the presence of hydrogen, under hydrogen pressure and temperature conditions making it possible to maintain said feedstock in the liquid phase and with an amount of soluble hydrogen which is just necessary for a selective hydrogenation of the diolefins present in the plastics pyrolysis oil. The selective hydrogenation of the diolefins in the liquid phase thus makes it possible to avoid or at least to limit the formation of "gums", that is to say the polymerization of the diolefins and thus the formation of oligomers and polymers, which can plug the reaction section of the hydrotreating stage b). Said selective hydrogenation stage a) makes it possible to obtain a hydrogenated effluent, that is to say an effluent with a reduced content of olefins, in particular of diolefins, preferably devoid of diolefins.

According to the invention, said selective hydrogenation stage a) is carried out in a reaction section fed at least with said feedstock comprising a plastics pyrolysis oil, or with the pretreated feedstock resulting from the optional pretreatment stage a0), and a gas stream comprising hydrogen ($H_2$). Optionally, the reaction section of said stage a) can also be fed with at least one fraction of a recycle stream, advantageously resulting from stage e), either as a mixture with said feedstock, which has optionally been pretreated, or separately from the feedstock, which has optionally been pretreated, advantageously directly at the inlet of at least one of the reactors of the reaction section of stage a), or also according to the two modes as mixture and separately from the feedstock, which has optionally been pretreated. The introduction of at least one fraction of said recycle stream into the reaction section of the selective hydrogenation stage a) advantageously makes it possible to dilute the impurities of the feedstock, which has optionally been pretreated, and to control the temperature in particular in said reaction section.

Said reaction section carries out a selective hydrogenation, preferably in a fixed bed, in the presence of at least one selective hydrogenation catalyst, advantageously at a temperature between 100 and 250° C., preferably between 110 and 200° C., in a preferred way between 130 and 180° C., a hydrogen partial pressure between 1.0 and 10.0 MPa abs. and at an hourly space velocity (HSV) between 1.0 and 10.0 $h^{-1}$. The hourly space velocity (HSV) is defined here as the ratio of the hourly flow rate by volume of the feedstock comprising the plastics pyrolysis oil, which has optionally been pretreated, to the volume of catalyst(s). The amount of the gas stream comprising hydrogen ($H_2$) feeding said reaction section of stage a) is advantageously such that the hydrogen coverage is between 1 and 200 $Sm^3$ of hydrogen per $m^3$ of feedstock ($Sm^3/m^3$), preferably between 1 and 50 $Sm^3$ of hydrogen per $m^3$ of feedstock ($Sm^3/m^3$), in a preferred way between 5 and 20 $Sm^3$ of hydrogen per $m^3$ of feedstock ($Sm^3/m^3$). The hydrogen coverage is defined as the ratio of the flow rate by volume of hydrogen, taken under standard temperature and pressure conditions, with respect to the flow rate by volume of "fresh" feedstock, that is to say of the feedstock to be treated, which has optionally been pretreated, without taking into account the possible recycled fraction, at 15° C. (in standard $m^3$, denoted $Sm^3$, of $H_2$ per $m^3$ of feedstock). The gas stream comprising hydrogen, which feeds the reaction section of stage a), can consist of a supply of hydrogen and/or of recycled hydrogen resulting in particular from the separation stage c).

Advantageously, the reaction section of said stage a) comprises between one and five reactors. According to a specific embodiment of the invention, the reaction section comprises between two and five reactors, which operate in permutable mode, referred to according to the term PRS for Permutable Reactor System or also "lead and lag". The combination of at least two reactors in PRS mode makes it possible to isolate a reactor, to discharge the spent catalyst, to recharge the reactor with fresh catalyst and to bring said reactor back into service without shutting down the process. The PRS technology is described in particular in the patent FR 2 681 871.

Advantageously, reactor internals, for example of filter plate type, can be used to prevent the plugging of the reactor(s). An example of a filter plate is described in the patent FR 3 051 375.

Advantageously, said at least one selective hydrogenation catalyst comprises a support, preferably an inorganic support, and a hydrodehydrogenating function.

The hydrodehydrogenating function comprises in particular at least one element from Group VIII, preferably chosen from nickel and cobalt, and/or at least one element from Group VIb, preferably chosen from molybdenum and tungsten. The total content of oxides of the metallic elements from Groups VIb and VIII (that is to say, the sum of the metallic elements from Groups VIb and VIII) is preferably between 1% and 40% by weight and preferentially from 5% to 30% by weight, with respect to the total weight of the catalyst. The ratio by weight, expressed as metal oxide, of the metal (or metals) from Group VIb with respect to the metal (or metals) from Group VIII is preferably between 1 and 20 and in a preferred way between 2 and 10. For example, the reaction section of said stage a) comprises a selective hydrogenation catalyst comprising between 0.5% and 10% by weight of nickel, preferably between 1% and 5% by weight of nickel (expressed as nickel oxide NiO with respect to the weight of said catalyst), and between 1% and 30% by weight of molybdenum, preferably between 3% and 20% by weight of molybdenum (expressed as molybdenum oxide $MoO_3$ with respect to the weight of said catalyst), on a preferably inorganic support.

The support of said at least one selective hydrogenation catalyst is preferably chosen from alumina, silica, silica-aluminas, magnesia, clays and their mixtures. Said support can include dopant compounds, in particular oxides chosen from boron oxide, especially boron trioxide, zirconia, ceria, titanium oxide, phosphorus pentoxide and a mixture of these oxides. Preferably, said at least one selective hydrogenation catalyst comprises an alumina support, preferably doped with phosphorus and optionally boron. When phosphorus pentoxide $P_2O_5$ is present, its concentration is less than 10% by weight, with respect to the weight of the alumina, and advantageously at least 0.001% by weight, with respect to the total weight of the alumina. When boron trioxide $B_2O_3$ is present, its concentration is less than 10% by weight, with respect to the weight of the alumina, and advantageously at least 0.001% by weight, with respect to the total weight of the alumina. The alumina used can, for example, be a $\gamma$ (gamma) or $\eta$ (eta) alumina.

Said selective hydrogenation catalyst is, for example, in the form of extrudates.

Very preferably, in order to hydrogenate the diolefins as selectively as possible, at least one selective hydrogenation catalyst used in stage a) comprises less than 1% by weight of nickel and at least 0.1% by weight of nickel, preferably 0.5% by weight of nickel, expressed as nickel oxide NiO with respect to the weight of said catalyst, and less than 5% by weight of molybdenum and at least 0.1% by weight of molybdenum, preferably 0.5% by weight of molybdenum, expressed as molybdenum oxide $MoO_3$ with respect to the weight of said catalyst, on an alumina support.

Optionally, the feedstock which comprises a plastics pyrolysis oil, which has optionally been pretreated, and/or optionally mixed beforehand with at least one fraction of a recycle stream advantageously resulting from stage e), can be mixed with the gas stream comprising hydrogen prior to its introduction into the reaction section.

Said feedstock, which has optionally been pretreated, and/or optionally mixed with at least one fraction of the recycle stream advantageously resulting from stage e), and/or optionally as a mixture with the gas stream, can also be heated before being introduced into the reaction section of stage a), for example by heat exchange in particular with the hydrotreating effluent from stage b), to reach a temperature close to the temperature employed in the reaction section which it feeds.

The content of impurities, in particular of diolefins, of the hydrogenated effluent obtained on conclusion of stage a) is reduced with respect to that of the same impurities, in particular diolefins, included in the feedstock of the process. The selective hydrogenation stage a) makes it possible to convert at least 90% and preferably at least 99% of the diolefins contained in the initial feedstock. Stage a) also makes it possible to remove, at least in part, other contaminants, such as, for example, silicon. The hydrogenated effluent, obtained on conclusion of the selective hydrogenation stage a), is sent, preferably directly, to the hydrotreating stage b). When at least one fraction of the recycle stream resulting from the optional stage e) is introduced, the hydrogenated effluent obtained on conclusion of the selective hydrogenation stage a) thus comprises, in addition to the converted feedstock, said fraction(s) of the recycle stream.

Hydrotreating Stage b)

According to the invention, the treatment process comprises a stage b) of hydrotreating, advantageously in a fixed bed, said hydrogenated effluent resulting from stage a), optionally mixed with at least one fraction of a recycle stream advantageously resulting from stage e), in the presence of hydrogen and of at least one hydrotreating catalyst, to obtain a hydrotreating effluent.

Advantageously, stage b) involves the hydrotreating reactions well known to a person skilled in the art, and more particularly reactions for the hydrogenation of olefins or of aromatics, hydrodemetallization, hydrodesulfurization, hydrodenitrogenation and the like.

Advantageously, said stage b) is carried out in a hydrotreating reaction section comprising at least one, preferably between one and five, fixed-bed reactors having n catalytic beds, n being an integer greater than or equal to one, preferably of between one and ten, in a preferred way of between two and five, said bed(s) each comprising at least one, and preferably not more than ten, hydrotreating catalysts. When a reactor comprises several catalytic beds, that is to say at least two, preferably between two and ten, in a preferred way between two and five catalytic beds, said catalytic beds are arranged in series in said reactor.

Said hydrotreating reaction section is fed at least with said hydrogenated effluent resulting from stage a) and a gas stream comprising hydrogen, advantageously at the level of the first catalytic bed of the first operating reactor.

Said hydrotreating reaction section of stage b) can also be fed with at least one fraction of the recycle stream advantageously resulting from the optional stage e). Said fraction(s) of said recycle stream or all of the recycle stream can be introduced into said hydrotreating reaction section as a mixture with the hydrogenated effluent resulting from stage a), separately from said hydrogenated effluent resulting from stage a) or according to the two modes as a mixture and separately from said hydrogenated effluent. Said fraction(s) of said recycle stream or all of the recycle stream can be introduced into said hydrotreating reaction section at the level of one or more catalytic beds of said hydrotreating reaction section of stage b). The introduction of at least one fraction of said recycle stream advantageously makes it possible to dilute the impurities still present in the hydrogenated effluent and to control the temperature, in particular to limit the increase in temperature, in the catalytic bed(s) of the hydrotreating reaction section which implements highly exothermic reactions. Advantageously, at the end of the hydrotreating stage b), all of the recycle stream resulting advantageously from the optional stage e) is reintroduced into the process according to the present invention, in a single injection or in several injections by fractions injected at the different stages a) and/or b), and/or optionally a0), of the process.

Advantageously, said hydrotreating reaction section is implemented at a pressure equivalent to that used in the reaction section of the selective hydrogenation stage a) but at a higher temperature than that of the reaction section of the selective hydrogenation stage a). Thus, said hydrotreating reaction section is advantageously implemented at a hydrotreating temperature between 250 and 430° C., preferably between 280 and 380° C., at a hydrogen partial pressure between 1.0 and 10.0 MPa abs. and at an hourly space velocity (HSV) between 0.1 and 10.0 $h^{-1}$, preferably between 0.1 and 5.0 $h^{-1}$, preferentially between 0.2 and 2.0 $h^{-1}$, in a preferred way between 0.2 and 0.8 $h^{-1}$. According to the invention, the "hydrotreating temperature" corresponds to a mean temperature in the hydrotreating reaction section of stage b). In particular, it corresponds to the weight-average bed temperature (WABT), which is well known to a person skilled in the art. The hydrotreating temperature is advantageously determined as a function of the catalytic systems, of the items of equipment and of the configuration of these which are used. For example, the hydrotreating temperature (or WABT) is calculated in the following way:

$$WABT=(T_{in}+2\times T_{out})/3$$

with $T_{in}$: the temperature of the hydrogenated effluent at the inlet of the hydrotreating reaction section, $T_{out}$: the temperature of the effluent at the outlet of the hydrotreating reaction section.

The hourly space velocity (HSV) is defined here as the ratio of the hourly flow rate by volume of the hydrogenated effluent resulting from stage a) per volume of catalyst(s). The hydrogen coverage in stage b) is advantageously of between 50 and 1000 $Sm^3$ of hydrogen per $m^3$ of fresh feedstock which feeds stage a), preferably between 50 and 500 $Sm^3$ of hydrogen per $m^3$ of fresh feedstock which feeds stage a) and in a preferred way between 100 and 300 $Sm^3$ of hydrogen per $m^3$ of fresh feedstock which feeds stage a). The hydrogen coverage is defined here as the ratio of the flow rate by volume of hydrogen, taken under standard temperature and pressure conditions, with respect to the flow rate by volume of fresh feedstock which feeds stage a), that is to say of feedstock comprising a plastics pyrolysis oil, or by the feedstock which has optionally been pretreated, which feeds stage a) (in standard $m^3$, denoted $Sm^3$, of $H_2$ per $m^3$ of fresh feedstock). The hydrogen can consist of a supply and/or of recycled hydrogen resulting in particular from the separation stage c).

Preferably, an additional gas stream comprising hydrogen is advantageously introduced into the inlet of each reactor, in particular operating in series, and/or into the inlet of each catalytic bed starting from the second catalytic bed of the hydrotreating reaction section. These additional gas streams are also referred to as cooling streams. They make it possible to control the temperature in the hydrotreating reactor in which the reactions carried out are generally highly exothermic.

Advantageously, said at least one hydrotreating catalyst used in said stage b) can be chosen from known hydrodemetallization, hydrotreating or silicon-scavenging catalysts used in particular for the treatment of petroleum cuts, and their combinations. Known hydrodemetallization catalysts are, for example, those described in the patents EP 0 113 297, EP 0 113 284, U.S. Pat. Nos. 5,221,656, 5,827,421, 7,119,045, 5,622,616 and 5,089,463. Known hydrotreating catalysts are, for example, those described in the patents EP 0 113 297, EP 0 113 284, U.S. Pat. Nos. 6,589,908, 4,818,743 or 6,332,976. Known silicon-scavenging catalysts are, for example, those described in the patent applications CN 102051202 and US 2007/080099.

In particular, said at least one hydrotreating catalyst comprises a support, preferably an inorganic support, and at least one metallic element having a hydrodehydrogenating function. Said at least one metallic element having a hydrodehydrogenating function advantageously comprises at least one element from Group VIII, preferably chosen from the group consisting of nickel and cobalt, and/or at least one element from Group VIb, preferably chosen from the group consisting of molybdenum and tungsten. The total content of oxides of the metallic elements from Groups VIb and VIII is preferably between 1% and 40% by weight, preferentially from 5% to 30% by weight, with respect to the total weight of the catalyst. The ratio by weight, expressed as metal oxide, of the metal (or metals) from Group VIb, with respect to the metal (or to the metals) from Group VIII, is preferably of between 1.0 and 20, in a preferred way between 2.0 and 10. For example, the hydrotreating reaction section of stage b) of the process comprises a hydrotreating catalyst comprising between 0.5% and 10% by weight of nickel, preferably between 1% and 5% by weight of nickel, expressed as nickel oxide NiO with respect to the total weight of the hydrotreating catalyst, and between 1.0% and 30% by weight of molybdenum, preferably between 3.0% and 20% by weight of molybdenum, expressed as molybdenum oxide $MoO_3$ with respect to the total weight of the hydrotreating catalyst, on an inorganic support.

The support of said at least one hydrotreating catalyst is advantageously chosen from alumina, silica, silica-aluminas, magnesia, clays and their mixtures. Said support can additionally include dopant compounds, in particular oxides chosen from boron oxide, especially boron trioxide, zirconia, ceria, titanium oxide, phosphorus pentoxide and a mixture of these oxides. Preferably, said at least one hydrotreating catalyst comprises an alumina support, preferably an alumina support doped with phosphorus and optionally boron. When phosphorus pentoxide $P_2O_5$ is present, its concentration is less than 10% by weight, with respect to the weight of the alumina, and advantageously at least 0.001% by weight, with respect to the total weight of the alumina. When boron trioxide $B_2O_3$ is present, its concentration is less than 10% by weight, with respect to the weight of the alumina, and advantageously at least 0.001% by weight, with respect to the total weight of the alumina. The alumina used can, for example, be a γ (gamma) or η (eta) alumina.

Said hydrotreating catalyst is, for example, in the form of extrudates.

Advantageously, said at least one hydrotreating catalyst used in stage b) of the process exhibits a specific surface of greater than or equal to 250 $m^2/g$, preferably of greater than or equal to 300 $m^2/g$. The specific surface of said hydrotreating catalyst is advantageously less than or equal to 800 $m^2/g$, preferably less than or equal to 600 $m^2/g$, in particular less than or equal to 400 $m^2/g$. The specific surface of the hydrotreating catalyst is measured by the BET method, that is to say the specific surface determined by nitrogen adsorption in accordance with the standard ASTM D 3663-78 drawn up from the Brunauer-Emmett-Teller method described in the periodical *The Journal of the American Chemical Society,* 60, 309 (1938). Such a specific surface makes it possible to further improve the removal of the contaminants, in particular of the metals, such as silicon.

The hydrotreating stage b) advantageously makes possible an optimized treatment of the hydrogenated effluent resulting from stage a). It in particular makes it possible to maximize the hydrogenation of the unsaturated bonds of the olefinic compounds present in the hydrogenated effluent resulting from stage a), the hydrodemetallization of said hydrogenated effluent and the scavenging of the metals, in particular silicon, still present in the hydrogenated effluent. The hydrotreating stage b) also makes possible the hydrodenitrogenation (HDN) of the hydrogenated effluent, that is to say the conversion of the nitrogenous entities still present in the hydrogenated effluent. Preferably, the nitrogen content of the hydrotreating effluent resulting from stage b) is less than or equal to 10 ppm by weight.

In a preferred embodiment of the invention, said hydrotreating reaction section comprises several fixed-bed reactors, preferentially between two and five, very preferentially between two and four, fixed-bed reactors, each having n catalytic beds, n being an integer greater than or equal to one, preferably of between one and ten, in a preferred way of between two and five, and advantageously operating in series and/or in parallel and/or in permutable (or PRS) mode and/or in "swing" mode. The various optional operating modes, PRS (or lead and lag) mode and swing mode, are well known to a person skilled in the art and are advantageously defined above. The advantage of a hydrotreating reaction section comprising several reactors lies in an optimized treatment of the hydrogenated effluent, while making it possible to reduce the risks of clogging of the catalytic bed(s) and thus to avoid shutdown of the unit due to clogging.

According to a very preferred embodiment of the invention, said hydrotreating reaction section comprises, preferably consists of:

(b1) two fixed-bed reactors operating in swing or PRS mode, preferably in PRS mode, each of the two reactors preferably having a catalytic bed advantageously comprising a hydrotreating catalyst preferably chosen from known hydrodemetallization or silicon-scavenging catalysts and their combinations, and (b2) at least one fixed-bed reactor, preferably one reactor, located downstream of the two reactors (b1), and advantageously operating in series with the two reactors (b1), said fixed-bed reactor (b2) containing between one and five catalytic beds arranged in series and each comprising between one and ten hydrotreating catalysts, at least one of said hydrotreating catalysts of which advantageously comprises a support and at least one metallic element preferably comprising at least one element from Group VIII, preferably chosen from nickel and cobalt, and/or at least one element from Group VIb, preferably chosen from molybdenum and tungsten.

Optionally, stage b) can employ a heating section located upstream of the hydrotreating reaction section and in which the hydrogenated effluent resulting from stage a) is heated to reach a temperature suitable for the hydrotreating, that is to say a temperature of between 250 and 430° C. Said optional heating section can thus comprise one or more exchangers, preferably making possible heat exchange between the hydrogenated effluent and the hydrotreating effluent, and/or a preheating furnace.

Advantageously, the hydrotreating stage b) makes possible the complete hydrogenation of the olefins present in the initial feedstock and those possibly obtained after the selective hydrogenation stage a), but also the at least partial conversion of other impurities present in the feedstock, such as aromatic compounds, metal compounds, sulfur compounds, nitrogen compounds, halogen compounds (in particular chlorine compounds) and oxygen compounds.

Stage b) can also make it possible to further reduce the content of contaminants, such as that of metals, in particular the content of silicon.

Separation Stage c)

According to the invention, the treatment process comprises a separation stage c), advantageously carried out in at least one washing/separation section, fed at least with the hydrotreating effluent resulting from stage b) and an aqueous solution, to obtain at least one gaseous effluent, an aqueous effluent and a hydrocarbon effluent.

The gaseous effluent obtained on conclusion of stage c) advantageously comprises hydrogen, preferably comprises at least 90 vol %, preferably at least 95 vol %, in a preferred way at least 99 vol %, of hydrogen. Advantageously, said gaseous effluent can be at least partly recycled to the selective hydrogenation stage a) and/or the hydrotreating stage b), it being possible for the recycling system to comprise a purification section.

The aqueous effluent obtained on conclusion of stage c) advantageously comprises ammonium salts and/or hydrochloric acid.

The hydrocarbon effluent resulting from stage c) comprises hydrocarbon compounds and advantageously corresponds to the plastics pyrolysis oil of the feedstock, or to the plastics pyrolysis oil and conventional petroleum feedstock fraction cotreated with the pyrolysis oil, freed at least in part from its impurities, in particular from its olefinic (di- and monoolef in), metallic or halogenated impurities.

This separation stage c) in particular makes it possible to remove the ammonium chloride salts, which are formed by reaction between the chloride ions, released by the hydrogenation of the chlorine compounds during stage b), and the ammonium ions, generated by the hydrogenation of the nitrogen compounds during stage b) and/or introduced by injection of an amine, and thus to limit the risks of plugging, in particular in the transfer lines and/or in the sections of the process of the invention and/or the transfer lines to the steam cracker, due to the precipitation of the ammonium chloride salts. It also makes it possible to remove the hydrochloric acid formed by the reaction of the hydrogen ions and the chloride ions.

Depending on the content of chlorine compounds in the initial feedstock to be treated, an amine stream can be injected upstream of the selective hydrogenation stage a), between the selective hydrogenation stage a) and the hydrotreating stage b) and/or between the hydrotreating stage b) and the separation stage c), preferably upstream of the selective hydrogenation stage a), in order to ensure a sufficient amount of ammonium ions to combine with the chloride ions formed during the hydrotreating stage, thus making it possible to limit the formation of hydrochloric acid and thus to limit the corrosion downstream of the separation section.

Advantageously, the separation stage c) comprises an injection of an aqueous solution, preferably an injection of water, into the hydrotreating effluent resulting from stage b), upstream of the washing/separation section, so as to at least partly dissolve ammonium chloride salts and/or hydrochloric acid and thus to improve the removal of the chlorinated impurities and to reduce the risks of pluggings due to an accumulation of the ammonium chloride salts.

The separation stage c) is advantageously carried out at a temperature of between 50 and 370° C., preferentially between 100 and 340° C., in a preferred way between 200 and 300° C. Advantageously, the separation stage c) is carried out at a pressure close to that employed in stages a) and/or b), preferably between 1.0 and 10.0 MPa, so as to facilitate the recycling of hydrogen.

The washing/separation section of stage c) can be at least partly carried out in common or separate items of washing and separation equipment, these items of equipment being well known (knockout drums which can be operated at various pressures and temperatures, pumps, heat exchangers, washing columns, and the like).

In an optional embodiment of the invention, taken in addition to or in isolation from other described embodiments of the invention, the separation stage c) comprises the injection of an aqueous solution into the hydrotreating effluent resulting from stage b), followed by the washing/separation section advantageously comprising a phase of separation which makes it possible to obtain at least one aqueous stream charged with ammonium salts, a washed liquid hydrocarbon stream and a partially washed gas stream. The aqueous stream charged with ammonium salts and the washed liquid hydrocarbon stream can subsequently be separated in a knockout drum in order to obtain said hydrocarbon effluent and said aqueous effluent. Said partially washed gas stream can, in parallel, be introduced into a washing column where it circulates countercurrentwise to an aqueous stream, preferably of the same nature as the aqueous solution injected into the hydrotreating effluent, which makes it possible to remove, at least partly and preferably completely, the hydrochloric acid contained in the partially washed gas stream and thus to obtain said gaseous effluent, preferably essentially comprising hydrogen, and an acidic aqueous stream. Said aqueous effluent resulting from the knockout drum can optionally be mixed with said acidic aqueous stream, and be used, optionally as a mixture with said acidic aqueous stream, in a water recycling circuit for feeding the separation stage c) with said aqueous solution upstream of the washing/separation section and/or with said aqueous stream in the washing column. Said water recycling circuit can comprise a supply of water and/or of a basic solution and/or a bleed making it possible to discharge the dissolved salts.

In another optional embodiment of the invention, taken separately or in combination with other described embodiments of the invention, the separation stage c) can advantageously comprise a "high-pressure" washing/separation section which operates at a pressure close to the pressure of the selective hydrogenation stage a) and/or of the hydrotreating stage b), in order to facilitate the recycling of hydrogen. This optional "high-pressure" section of stage c) can be supplemented by a "low-pressure" section, in order to obtain a liquid hydrocarbon fraction devoid of a portion of the gases dissolved at high pressure and intended to be treated directly in a steam cracking process or optionally to be sent into the fractionation stage d).

The hydrocarbon effluent resulting from the separation stage c) is sent, partly or completely, either directly to the inlet of a steam cracking unit or to an optional fractionation stage d). Preferably, the liquid hydrocarbon effluent is sent, partly or completely, preferably completely, to a fractionation stage d).

Fractionation Stage d) (Optional)

The process according to the invention can comprise a stage of fractionating all or part, preferably all, of the hydrocarbon effluent resulting from stage c), to obtain at least one gas stream and at least one hydrocarbon stream.

In a specific embodiment, the optional fractionation stage d) can make it possible to obtain, in addition to said at least one gas stream, at least two hydrocarbon streams having different boiling points from one another. Said fractionation stage d) can, for example, make it possible to obtain, in addition to a gas stream, a naphtha cut comprising compounds having a boiling point of less than 150° C., preferably between 80 and 150° C., and a hydrocarbon cut comprising compounds having a boiling point of greater than 150° C., or a naphtha cut comprising compounds having a boiling point of less than 150° C., in particular between 80 and 150° C., a diesel cut comprising compounds having a boiling point between 150° C. and 385° C. and a hydrocarbon cut comprising compounds having a boiling point of greater than 385° C., referred to as heavy hydrocarbon cut.

Stage d) makes it possible, in particular under the action of a stream of steam, in particular to remove the gases dissolved in the liquid hydrocarbon effluent, such as, for example, ammonia, hydrogen sulfide and light hydrocarbons having from 1 to 4 carbon atoms.

The optional fractionation stage d) is advantageously carried out at a pressure of less than or equal to 1.0 MPa abs., preferably between 0.1 and 1.0 MPa abs.

According to one embodiment, stage d) can be carried out in a section advantageously comprising at least one stripping column equipped with a reflux circuit comprising a reflux drum. Said stripping column is fed with the liquid hydrocarbon effluent resulting from stage c) and with a stream of steam. The liquid hydrocarbon effluent resulting from stage c) can optionally be heated before entering the stripping column. Thus, the lightest compounds are entrained in the column top and into the reflux circuit comprising a reflux drum in which a gas/liquid separation is carried out. The gas phase which comprises the light hydrocarbons is withdrawn from the reflux drum in a gas stream. At least one fraction of the liquid phase is advantageously withdrawn from the reflux drum, in a hydrocarbon stream with a relatively low boiling point, for example a naphtha cut with a boiling point of less than 150° C. A hydrocarbon stream, which is advantageously liquid, with a higher boiling point than the hydrocarbon stream withdrawn at the column top, for example of greater than 150° C., is withdrawn at the bottom of the stripping column.

According to other embodiments, the fractionation stage d) can employ a stripping column followed by a distillation column or only a distillation column.

The hydrocarbon stream(s) obtained, for example the naphtha cut comprising compounds having a boiling point of less than 150° C. and the cut comprising compounds having a boiling point of greater than 150° C., which are optionally mixed, can be sent, in all or in part, preferably in part, to a steam cracking unit, on conclusion of which olefins may be (re)formed to participate in the formation of polymers. Preferably, a part only of the or of at least one of the hydrocarbon stream(s) obtained is sent to a steam cracking unit; at least one fraction of the remaining part of the or of at least one of the hydrocarbon stream(s) obtained is optionally sent to the recycling stage e) and/or to a fuel pool, for example naphtha pool, diesel pool or kerosene pool, resulting from conventional petroleum feedstocks.

For example, on conclusion of the optional fractionation stage d) which made it possible to obtain two hydrocarbon streams, the naphtha stream advantageously comprising compounds having a boiling point of less than 150° C. can be sent, in all or part, to a naphtha pool, that is to say to the naphtha effluents resulting from more conventional petroleum feedstocks, the second hydrocarbon stream advantageously comprising compounds having a boiling point of greater than 150° C. being, for its part, sent, in all or part, to a steam cracking unit. According to another example, the optional stage d) results in at least a naphtha cut (in particular comprising compounds having a boiling point of less than 150° C.), a diesel cut (in particular comprising compounds having a boiling point between 150° C. and 385° C.) and a heavy cut (in particular comprising compounds having a boiling point of greater than 385° C.) being obtained; the naphtha cut can be sent, in all or part, to the naphtha pool resulting from conventional petroleum feedstocks; the diesel cut can also be, in all or part, either sent to a steam cracking unit or to a diesel pool resulting from conventional petroleum feedstocks; the heavy cut can, for its part, be sent, at least in part, to a steam cracking unit or optionally sent, at least in part, to another unit for the treatment of conventional petroleum feedstocks, such as, for example, a unit for the treatment of vacuum distillates, such as a hydrocracking unit.

Stage e) (Optional) of Recycling a Part of the Product

The process according to the invention can comprise the recycling stage e), in which a fraction of the hydrocarbon effluent resulting from the separation stage c) or a fraction of the or of at least one of the hydrocarbon stream(s) resulting from the optional fractionation stage d) is recovered to constitute a recycle stream which is sent upstream of or directly to at least one of the reaction stages of the process according to the invention, in particular to the selective hydrogenation stage a) and/or the hydrotreating stage b). Optionally, a fraction of the recycle stream can be sent to the optional stage a0). Preferably, the process according to the invention comprises the recycling stage e).

The recycling stage e) comprises a phase of recovery of a fraction of the hydrocarbon effluent resulting from the separation stage c) or a fraction of the or of at least one of the hydrocarbon stream(s) resulting from the optional fractionation stage d), to constitute the recycle stream, and a phase of recycling said recycle stream at least to the selective hydrogenation stage a), to the hydrotreating stage b) or at least to stages a) and b). The recycle stream can feed said reaction stages a) or b) in a single injection or can be divided into several fractions to feed the reaction stages a) and/or b) in several injections, that is to say at the different catalytic beds. Preferably, at least one fraction of the recycle stream feeds the hydrotreating stage b). Optionally, a fraction of the recycle stream can feed the optional pretreatment stage a0). Preferably, at the end of stage b), the whole of the recycle stream is reintroduced into the process.

Advantageously, the amount of the recycle stream, that is to say the recycled fraction of product obtained, is adjusted so that the ratio by weight of the recycle stream to the feedstock comprising a plastics pyrolysis oil, that is to say the feedstock to be treated feeding the overall process, is less than or equal to 10, preferably less than or equal to 5, and preferentially greater than or equal to 0.001, preferably greater than or equal to 0.01 and in a preferred way greater than or equal to 0.1. Very preferably, the amount of the recycle stream is adjusted so that the ratio by weight of the recycle stream to the feedstock comprising a plastics pyrolysis oil is between 0.2 and 5.

Advantageously, for the starting phases of the process, a hydrocarbon cut external to the process can be used as recycle stream. A person skilled in the art will then know how to choose said hydrocarbon cut.

The recycling of a part of the product obtained to or upstream of at least one of the reaction stages of the process according to the invention advantageously makes it possible, on the one hand, to dilute the impurities and, on the other hand, to control the temperature in the reaction stage(s), in which the reactions involved can be highly exothermic.

According to a preferred embodiment of the invention, the process for the treatment of a feedstock comprising a plastics pyrolysis oil comprises, preferably consists of, the sequence of the stages, and preferably in the order given, a) of selective hydrogenation, b) of hydrotreating, c) of separation and d) of fractionation, to produce a treated plastics pyrolysis oil with a composition compatible with entry into a steam cracking unit.

According to another preferred embodiment of the invention, the process for the treatment of a feedstock comprising a plastics pyrolysis oil comprises, preferably consists of, the sequence of the stages, and preferably in the order given, a0) of pretreatment, a) of selective hydrogenation, b) of hydrotreating, c) of separation and d) of fractionation, to produce a treated plastics pyrolysis oil with a composition compatible with entry into a steam cracking unit.

According to a third preferred embodiment of the invention, the process for the treatment of a feedstock comprising a plastics pyrolysis oil comprises, preferably consists of, the sequence of the stages, and preferably in the order given, a) of selective hydrogenation, b) of hydrotreating, c) of separation, d) of fractionation and e) of recycling of a fraction of the product, to produce a treated plastics pyrolysis oil with a composition compatible with entry into a steam cracking unit.

According to a fourth preferred embodiment of the invention, the process for the treatment of a feedstock comprising a plastics pyrolysis oil comprises, preferably consists of, the sequence of the stages, and preferably in the order given, a0) of pretreatment, a) of selective hydrogenation, b) of hydrotreating, c) of separation, d) of fractionation and e) of recycling of a fraction of the product, to produce a treated plastics pyrolysis oil with a composition compatible with entry into a steam cracking unit.

Said hydrocarbon effluent or said hydrocarbon stream(s) thus obtained by treatment according to the process of the invention of a plastics pyrolysis oil exhibit(s) a composition compatible with the specifications of a feedstock at entry into a steam cracking unit. In particular, the composition of the hydrocarbon effluent or of said hydrocarbon stream(s) is preferably such that:

- the total content of metallic elements is less than or equal to 5.0 ppm by weight, preferably less than or equal to 2.0 ppm by weight, preferentially less than or equal to 1.0 ppm by weight and in a preferred way less than or equal to 0.5 ppm by weight, with:
- a content of silicon (Si) element of less than or equal to 1.0 ppm by weight, preferably of less than or equal to 0.6 ppm by weight, and a content of iron (Fe) element of less than or equal to 100 ppb by weight,
- the sulfur content is less than or equal to 500 ppm by weight, preferably less than or equal to 200 ppm by weight,
- the nitrogen content is less than or equal to 500 ppm by weight, preferably less than or equal to 200 ppm by weight,
- the content of asphaltenes is less than or equal to 5.0 ppm by weight,
- the total content of chlorine element is less than or equal to 50 ppb by weight,
- the content of olefinic compounds (monoolef ins and diolef ins) is less than or equal to 5.0% by weight, preferably less than or equal to 2.0% by weight, in a preferred way less than or equal to 0.5% by weight.

The contents are given as relative concentrations by weight, percentages (%) by weight, part(s) per million (ppm) by weight or part(s) per billion (ppb) by weight, with respect to the total weight of the stream under consideration.

The process according to the invention thus makes it possible to treat plastics pyrolysis oils in order to obtain an effluent which can be injected, in all or part, into a steam cracking unit. The process according to the invention thus makes it possible to upgrade plastics pyrolysis oils, while reducing the formation of coke and thus the risks of plugging and/or of premature losses of activity of the catalyst(s) used in the steam cracking unit, and while reducing the corrosion risks.

Steam Cracking Stage f) (Optional)

The hydrocarbon effluent resulting from the separation stage c), or the or at least one of the hydrocarbon stream(s) resulting from the optional stage d), can be, in all or part, sent to a steam cracking stage f).

Said steam cracking stage f) is advantageously carried out in at least one pyrolysis furnace at a temperature of between 700 and 900° C., preferably between 750 and 850° C., and at a pressure of between 0.05 and 0.3 MPa relative. The residence time of the hydrocarbon compounds is generally less than or equal to 1.0 second (denoted s), preferably of between 0.1 and 0.5 s. Advantageously, steam is introduced upstream of the optional steam cracking stage f) and after the separation (or the fractionation). The amount of water introduced, advantageously in the form of steam, is between 0.3 and 3.0 kg of water per kg of hydrocarbon compounds at the entry to stage f). Preferably, the optional stage f) is carried out in several pyrolysis furnaces in parallel, so as to adapt the operating conditions to the various streams feeding stage f), in particular resulting from stage d), and also to manage the decoking times of the tubes. A furnace comprises one or more tubes arranged in parallel. A furnace can also denote a group of furnaces operating in parallel. For example, one furnace can be dedicated to the cracking of a hydrocarbon stream comprising compounds having a boiling point of less than 150° C., in particular between 80 and 150° C., and another furnace dedicated to the hydrocarbon stream comprising compounds having a boiling point of greater than 150° C.

This steam cracking stage f) makes it possible to obtain at least one effluent containing olefins comprising 2, 3 and/or 4 carbon atoms (that is to say $C_2$, $C_3$ and/or $C_4$ olefins), at satisfactory contents, in particular of greater than or equal to 30% by weight, in particular of greater than or equal to 40% by weight, indeed even of greater than or equal to 50% by weight, of total olefins comprising 2, 3 and 4 carbon atoms, with respect to the weight of the steam cracking effluent under consideration. Said $C_2$, $C_3$ and $C_4$ olefins can subsequently be advantageously used as polyolefin monomers.

According to one or more preferred embodiments of the invention, taken separately or combined together, the process for the treatment of a feedstock comprising a plastics pyrolysis oil comprises, preferably consists of, the sequence of the stages described above, and preferably in the order given, that is to say: the pretreatment stage a0), the selective hydrogenation stage a), the hydrotreating stage b), the separation stage c), optionally the fractionation stage d) and the steam cracking stage f).

The process according to the invention, when it comprises this steam cracking stage f), thus makes it possible, starting from oils from the pyrolysis of plastics, for example of plastic waste, to obtain olefins which can be used as monomers in the synthesis of novel polymers contained in plastics, in relatively satisfactory yields, without plugging or corrosion of the units.

The following figures and examples illustrate the invention without limiting the scope thereof.

Analysis Methods Used

The analysis methods and/or standards used to determine the characteristics of the various streams, in particular of the feedstock to be treated and of the effluents, are known to a person skilled in the art. They are in particular listed below:

TABLE 1

| Characteristics | Methods |
|---|---|
| Density @15° C. | ASTM D4052 |
| Sulfur content | ISO 20846 |
| Nitrogen content | ASTM D4629 |
| Acid number | ASTM D664 |
| Bromine content | ASTM D1159 |
| Diolefins content from the Maleic Anhydride Value | MAV Method as described in the paper: C. López-García et al., Near Infrared Monitoring of Low Conjugated Diolefins Content in Hydrotreated FCC Gasoline Streams, *Oil & Gas Science and Technology* - Rev. IFP, Vol. 62 (2007), No. 1, 57-68 |
| Content of oxygen compounds | Combustion + Infrared |
| Content of paraffins | UOP990-11 |

TABLE 1-continued

| Characteristics | Methods |
|---|---|
| Content of naphthenes | UOP990-11 |
| Content of olefins | UOP990-11 |
| Content of aromatics | UOP990-11 |
| Content of halogens | ASTM-D7359 |
| Content of asphaltenes | IFP9313 |
| Chloride content | ASTM D7536 |
| Content of metals: | ASTM-D5185 |
| P | |
| Fe | |
| Si | |
| Na | |
| B | |
| Simulated Distillation | ASTM D2887 |

LIST OF THE FIGURES

Figure 2:
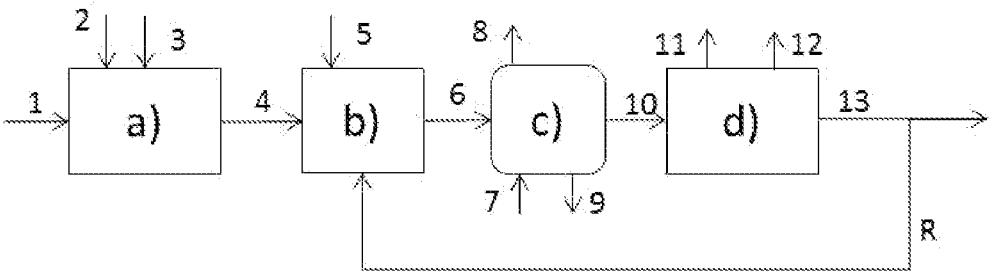
Figure 3:
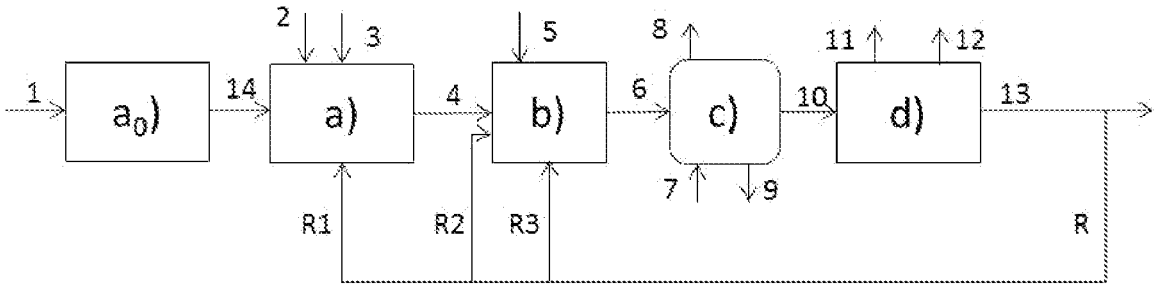

The particulars of the elements referenced in FIGS. 1 to 3 makes possible a better understanding of the invention, without the latter being limited to the specific embodiments illustrated in FIGS. 1 to 3. The various embodiments presented can be used alone or in combination with one another, without limitation of combination.

FIG. 1 represents the diagram of a specific embodiment of the process of the present invention, comprising:

- a stage a) of selective hydrogenation of a hydrocarbon feedstock resulting from the pyrolysis of plastics 1, in the presence of a hydrogen-rich gas 2, of a fraction R1 of a recycle stream R and optionally of an amine supplied by the stream 3, carried out in at least one fixed-bed reactor comprising at least one selective hydrogenation catalyst, to obtain an effluent 4;
- a stage b) of hydrotreating the effluent 4 resulting from stage a), in the presence of hydrogen 5 and of two fractions R2 and R3 of a recycle stream R, carried out in at least one fixed-bed reactor comprising at least one hydrotreating catalyst, to obtain a hydrotreated effluent 6;
- a stage c) of separation of the effluent 6 carried out in the presence of an aqueous washing solution 7 and making it possible to obtain at least one fraction 8 comprising hydrogen, an aqueous fraction 9 containing dissolved salts, and a liquid hydrocarbon fraction 10;
- the recycling of a part R of the hydrocarbon fraction 10 resulting from stage c), said part R constituting the recycle stream and being divided into three fractions R1, R2 and R3, to feed the selective hydrogenation stage a) (fraction R1) and the hydrotreating stage b) (fractions R2 and R3).

Instead of injecting the amine stream 3 at the inlet of the selective hydrogenation stage a), it is possible to inject it at the inlet of the hydrotreating stage b), at the inlet of the separation stage c), or else not to inject it, depending on the characteristics of the feedstock.

FIG. 2 represents another specific embodiment of the process according to the invention. In the embodiment shown in FIG. 2, the liquid hydrocarbon fraction 10, obtained on conclusion of stage c), is sent to a fractionation stage d) which makes it possible to obtain at least one gaseous fraction 11, a fraction comprising naphtha 12 and a hydrocarbon fraction 13. A part R of the hydrocarbon fraction 13 resulting from stage d) constitutes the recycle stream which feeds the hydrotreating stage b).

FIG. 3 represents an alternative form of the implementation of the process according to the invention represented in FIG. 1. In the embodiment shown in FIG. 3, the hydrocarbon feedstock resulting from the pyrolysis of plastics 1 undergoes a pretreatment stage a0), prior to the selective hydrogenation stage a). The then pretreated feedstock 14 feeds the selective hydrogenation stage a). Furthermore, the liquid hydrocarbon fraction 10 obtained on conclusion of stage c) is sent to a fractionation stage d) making it possible to obtain at least one gaseous fraction 11, a fraction comprising naphtha 12 and a hydrocarbon fraction 13. A recycle stream R, consisting of a part of the hydrocarbon fraction 13, is divided into three fractions R1, R2 and R3, to feed the selective hydrogenation stage a) (fraction R1) and the hydrotreating stage b) (fractions R2 and R3).

Only the main stages, with the main streams, are represented in FIGS. 1 to 3, in order to make it possible for the invention to be better understood. It is clearly understood that all the items of equipment required for the operation are present (drums, pumps, exchangers, furnaces, columns, and the like), even if not represented. It is also understood that gas streams rich in hydrogen (supply or recycle), as described above, can be injected at the inlet of each reactor or catalytic bed or between two reactors or two catalytic beds. Means well known to a person skilled in the art for the purification and recycling of hydrogen can also be employed.

On conclusion of stage d), the fraction comprising naphtha 12 and/or the hydrocarbon fraction 13 is/are sent to a steam cracking process.

EXAMPLES

Example 1 (in Accordance with the Invention)

The feedstock 1 treated in the process is a plastics pyrolysis oil (that is to say, comprising 100% by weight of said plastics pyrolysis oil) exhibiting the characteristics indicated in table 2.

TABLE 2

Characteristics of the feedstock

| Description | Methods | Unit | Pyrolysis oil |
|---|---|---|---|
| Density @15° C. | ASTM D4052 | g/cm$^3$ | 0.820 |
| Sulfur content | ISO 20846 | ppm by weight | 2500 |
| Nitrogen content | ASTM D4629 | ppm by weight | 730 |
| Acid number | ASTM D664 | mgKOH/g | 1.5 |
| Bromine content | ASTM D1159 | g/100 g | 80 |
| Diolefins content from the Maleic Anhydride Value | MAV Method[(1)] | % by weight | 10 |
| Content of oxygen compounds | Combustion + Infrared | % by weight | 1.0 |
| Content of paraffins | UOP990-11 | % by weight | 45 |
| Content of naphthenes | UOP990-11 | % by weight | 20 |
| Content of olefins | UOP990-11 | % by weight | 25 |
| Content of aromatics | UOP990-11 | % by weight | 10 |
| Content of halogens | ASTM-D7359 | ppm by weight | 350 |
| Content of asphaltenes | IFP9313 | ppm by weight | 380 |
| Chloride content | ASTM D7536 | ppm by weight | 320 |
| Content of metals: | ASTM-D5185 | | |
| P | | ppm by weight | 10 |
| Fe | | ppm by weight | 25 |
| Si | | ppm by weight | 45 |
| Na | | ppm by weight | 2 |
| B | | ppm by weight | 2 |
| Simulated Distillation: | ASTM D2887 | | |
| 0% | | ° C. | 40 |
| 10% | | ° C. | 98 |
| 30% | | ° C. | 161 |

TABLE 2-continued

Characteristics of the feedstock

| Description | Methods | Unit | Pyrolysis oil |
|---|---|---|---|
| 50% | | ° C. | 232 |
| 70% | | ° C. | 309 |
| 90% | | ° C. | 394 |
| 100% | | ° C. | 432 |

(1)MAV method described in the paper: C. López-García et al., Near Infrared Monitoring of Low Conjugated Diolefins Content in Hydrotreated FCC Gasoline Streams, *Oil & Gas Science and Technology* - Rev. IFP, Vol. 62 (2007), No. 1, pp. 57-68

The feedstock 1 is subjected to a selective hydrogenation stage a) carried out in a fixed-bed reactor and in the presence of hydrogen 2 and of a selective hydrogenation catalyst of the NiMo-on-Alumina type, under the conditions indicated in table 3.

TABLE 3

Conditions of the selective hydrogenation stage a)

| | | |
|---|---|---|
| Temperature | ° C. | 150 |
| Hydrogen partial pressure | MPa abs. | 6.4 |
| $H_2$/HC (Hydrogen coverage by volume, with respect to the volume of feedstock) | Sm$^3$/m$^3$ | 10 |
| HSV (flow rate by volume of feedstock/volume of catalysts) | h$^{-1}$ | 6 |

On conclusion of the selective hydrogenation stage a), all of the diolefins initially present in the feedstock were converted.

The effluent 4 resulting from the selective hydrogenation stage a) is subjected directly, without separation, to a hydrotreating stage b) carried out in a fixed bed and in the presence of hydrogen 5, of a hydrocarbon recycle stream R and of a hydrotreating catalyst of NiMo-on-Alumina type under the conditions presented in table 4.

TABLE 4

Conditions of the hydrotreating stage b)

| | | |
|---|---|---|
| Hydrotreating temperature | ° C. | 355 |
| Hydrogen partial pressure | MPa abs. | 6.2 |
| $H_2$/HC (Hydrogen coverage by volume, with respect to the volume of feedstock) | Sm$^3$/m$^3$ | 300 |
| HSV (flow rate by volume of feedstock/volume of catalysts) | h$^{-1}$ | 0.5 |

The effluent 6 resulting from the hydrotreating stage b) is subjected to a separation stage c) in which a stream of water is injected into the effluent resulting from the hydrotreating stage b); the mixture is subsequently treated in an acid gas washing column and knockout drums. The liquid effluent obtained is then sent to a fractionation stage d) which comprises a stripping column. The yields of the various fractions obtained after separation and fractionation are shown in table 5 (the yields being corresponding to the ratios of the amounts by weight of the various products obtained, with respect to the weight of feedstock upstream of the stage a), expressed as percentage and denoted % w/w).

TABLE 5

Yields of the various products obtained after separation and fractionation

| | | |
|---|---|---|
| $NH_3 + H_2S$ | % w/w | 0.35 |

TABLE 5-continued

| Yields of the various products obtained after separation and fractionation | | |
|---|---|---|
| $C_1$-$C_4$ Fraction | % w/w | 0.50 |
| IP-150° C. Fraction | % w/w | 28.10 |
| 150° C. + Fraction | % w/w | 71.40 |
| IP+ Fraction (mixture of the IP-150° C. and 150° C.+ fractions) | % w/w | 99.50 |

A part of the 150° C.+ fraction is recycled to the hydrotreating stage b) in the form of a recycle stream. The amount of 150° C.+ fraction is adjusted so that the ratio by weight of the recycled fraction to the fresh feedstock 1 is 1.

It appears that the temperature difference between the inlet and the outlet of the hydrotreating reaction section, the hydrotreating temperature (or mean hydrotreating temperature, WABT) being adjusted to 355° C., is reduced in comparison with a process in accordance with the invention but not comprising recycling of a fraction of the hydrocarbon effluent obtained. This means that the recycling of a fraction of the hydrocarbon effluent obtained makes it possible to control the temperature in the hydrotreating reaction section in which the reactions involved are highly exothermic.

The characteristics of the IP-150° C. and 150° C.+ liquid fractions (and also the IP+ fraction which is the sum of the IP-150° C. and 150° C.+ fractions) obtained after the separation stage c) and a fractionation stage are presented in table 6:

TABLE 6

| Characteristics of the IP-150° C., 150° C.+ and IP+ fractions | | | | |
|---|---|---|---|---|
| Analysis (method) | | IP-150° C. Fraction | 150° C.+ Fraction | IP+ Fraction |
| Density @ 15° C. (ASTM D4052) | g/cm³ | 0.750 | 0.827 | 0.804 |
| Content of: | | | | |
| Sulfur (ASTM D5453) | ppm by weight | <2 | <10 | <10 |
| Nitrogen (ASTM D4629) | ppm by weight | <0.5 | <5 | <5 |
| Fe (ASTM D5185) | ppb by weight | Not detected | <50 | <50 |
| Total metals (ASTM D5185) | ppm by weight | Not detected | <1 | <1 |
| Chlorine (ASTM D7536) | ppb by weight | Not detected | <25 | <25 |
| Paraffins (UOP990-11) | % by weight | 68 | 65 | 66 |
| Naphthenes (UOP990-11) | % by weight | 30.5 | 33 | 32 |
| Olefins (UOP990-11) | % by weight | Not detected | Not detected | Not detected |
| Aromatics (UOP990-11) | % by weight | 1.5 | 2 | 2 |
| Simulated Distillation(ASTM D2687) | | | | |
| 0% | ° C. | 25 | 150 | 25 |
| 5% | ° C. | 32 | 162 | 53 |
| 10% | ° C. | 40 | 174 | 92 |
| 30% | ° C. | 82 | 226 | 155 |
| 50% | ° C. | 108 | 281 | 227 |
| 70% | ° C. | 126 | 346 | 305 |
| 90% | ° C. | 142 | 395 | 391 |
| 95% | ° C. | 146 | 404 | 398 |
| 100% | ° C. | 150 | 432 | 432 |

The IP-150° C. and 150° C.+ liquid fractions both exhibit compositions compatible with a steam cracking unit since:

they do not contain olefins (monoolef ins and diolefins);

they exhibit contents of chlorine element which are very low (respectively a not detected content and a content of 25 ppb by weight) and below the limit required for a steam cracker feedstock (≤50 ppb by weight);

the contents of metals, in particular of iron (Fe), are themselves also very low (contents of metals not detected for the IP-150° C. fraction and <1 ppm by weight for the 150° C.+ fraction; contents of Fe not detected for the IP-150° C. fraction and 50 ppb by weight for the 150° C.+ fraction) and below the limits required for a steam cracker feedstock (≤5.0 ppm by weight, very preferably ≤1 ppm by weight for metals; ≤100 ppb by weight for Fe);

finally, they contain sulfur (<2 ppm by weight for the IP-150° C. fraction and <10 ppm by weight for the 150° C.+ fraction) and nitrogen (<0.5 ppm by weight for the IP-150° C. fraction and <5 ppm by weight for the 150° C.+ fraction) at contents which are far below the limits required for a steam cracker feedstock (≤500 ppm by weight, preferably ≤200 ppm by weight for S and N).

It also appears that the mixture of the two liquid fractions, named IP+, also exhibits very low contents of olefins and of contaminants (in particular of metals, chlorine, sulfur, nitrogen), making the composition compatible with a steam cracking unit.

The IP-150° C. and 150° C.+ liquid fractions obtained are thus subsequently sent to a steam cracking stage where the liquid fractions are cracked under different conditions (cf. table 7). The IP+ mixture can also be sent directly to a stage of steam cracking according to the conditions mentioned in table 7.

TABLE 7

| Conditions of the steam cracking stage | | |
|---|---|---|
| Pressure at furnace exit | MPa abs. | 0.2 |
| Temperature at furnace exit of IP-150° C. fraction | ° C. | 800 |
| Temperature at furnace exit of 150° C.+ fraction | ° C. | 790 |
| Temperature at furnace exit of IP+ fraction | ° C. | 795 |
| Steam/IP-150° C. fraction ratio | kg/kg | 0.6 |
| Steam/150° C.+ fraction ratio | kg/kg | 0.8 |
| Steam/IP+ fraction ratio | kg/kg | 0.7 |
| Furnace residence time of IP-150° C. fraction | s | 0.3 |
| Furnace residence time of 150° C.+ fraction | s | 0.3 |
| Furnace residence time of IP+ fractions | s | 0.3 |

The effluents from the various steam cracking furnaces are subjected to a separation stage which makes it possible to recycle the saturated compounds to the steam cracking furnaces and to obtain the yields presented in table 8 (yield=% by weight of product with respect to the weight of each of the fractions upstream of the steam cracking stage, denoted % w/w).

TABLE 8

| Yields of the steam cracking stage | | | | |
|---|---|---|---|---|
| Fractions | | IP-150° C. Fraction | 150° C.+ Fraction | IP+ Fraction |
| $H_2$, CO, $C_1$ | % w/w | 7.8 | 7.9 | 8.1 |
| Ethylene | % w/w | 33.7 | 34.2 | 34.8 |
| Propylene | % w/w | 18.3 | 18.6 | 19.0 |
| $C_4$ cut | % w/w | 14.6 | 14.8 | 15.1 |
| Pyrolysis gasoline | % w/w | 19.8 | 19.4 | 18.8 |
| Pyrolysis oil | % w/w | 5.7 | 5.1 | 4.2 |

By considering the yields obtained for the various IP-150° C. and 150° C.+ liquid fractions (and their IP+ mixture) during the process for the treatment of the pyrolysis oil (cf. table 5), it is possible to determine the overall yields of the products resulting from the steam cracking stage with respect to the initial feedstock of plastics pyrolysis oil type introduced in stage a):

TABLE 9

Overall yields for the process followed by the steam cracking stage

| Fractions | | IP-150° C. Fraction | 150° C.+ Fraction | IP+ Fraction |
|---|---|---|---|---|
| $H_2$, CO, $C_1$ | % w/w | 2.2 | 5.6 | 8.0 |
| Ethylene | % w/w | 9.5 | 24.4 | 34.7 |
| Propylene | % w/w | 5.2 | 13.3 | 18.9 |
| $C_4$ cut | % w/w | 4.1 | 10.6 | 15.1 |
| Pyrolysis gasoline | % w/w | 5.6 | 13.9 | 18.7 |
| Pyrolysis oil | % w/w | 1.6 | 3.6 | 4.2 |

When the IP+ liquid fraction is subjected to a steam cracking stage, the process according to the invention makes it possible to achieve overall yields by weight of ethylene and propylene respectively of 34.7% and 18.9%, with respect to the amount by weight of initial feedstock of plastics pyrolysis oil type. When the IP-150° C. and 150° C.+ fractions are sent separately to the steam cracking unit, the process according to the invention makes it possible to achieve overall yields by weight of ethylene and propylene respectively of 33.9% (=9.5+24.4) and 18.5% (=5.2+13.3), with respect to the amount by weight of initial feedstock of plastics pyrolysis oil type.

Furthermore, the specific sequence of stages upstream of the steam cracking stage makes it possible to limit the formation of coke and to avoid the problems of corrosion which would have appeared if the chlorine had not been removed.

Example 2 (in Accordance with the Invention)

In this example, the fractionation stage includes, in addition to a stripping column, a distillation section so as to obtain a diesel cut which can be incorporated directly in a diesel pool, that is to say corresponding to the specifications required for a diesel and in particular the specification of T90 D86 at 360° C.

The feedstock to be treated is identical to that described in example 1 (cf. table 2).

It is subjected to the selective hydrogenation stage a), the hydrotreating stage b) and the separation stage c) carried out under the same conditions as those described in example 1. The liquid effluent obtained on conclusion of the separation stage c) is sent to a stripping column, as in example 1. On conclusion of the stripping column, the two IP-150° C. and 150° C.+ fractions are obtained, as in example 1. They have the same characteristics as those of example 1 (cf. table 6). The 150° C.+ fraction is sent to a distillation column where it is distilled into two cuts: a 150-385° C. cut and a 385° C.+ cut. A part of the 385° C.+ cut is recovered to constitute a recycle stream R which is sent to the hydrotreating stage b).

Similarly to the process described in example 1, the temperature difference between the inlet and the outlet of the hydrotreating reaction section is limited in comparison with a process without recycle.

Table 10 gives the overall yields of the various fractions obtained on conclusion of the separation stage c) and the fractionation stage d) (which comprises a stripping column and a distillation column).

TABLE 10

Yields of the various products obtained after separation and fractionation

| | | |
|---|---|---|
| $NH_3$ + $H_2S$ | % w/w | 0.35 |
| $C_1$-$C_4$ Fraction | % w/w | 0.50 |
| IP-150° C. Fraction | % w/w | 28.10 |
| 150-385° C. Fraction | % w/w | 60.90 |
| 385° C.+ Fraction | % w/w | 14.63 |

Table 11 gives the characteristics of the 150-385° C. and 385° C.+ cuts, and the EN-590 commercial specifications of a diesel.

TABLE 11

Characteristics of the 150-385° C. and 385° C.+ cuts, and EN-590 commercial specifications

| Characteristics | Units | 150-385° C. Cut | 385° C.+ Cut | EN-590 Specifications |
|---|---|---|---|---|
| Density @ 15° C. | g/cm$^3$ | 0.824 | 0.844 | 0.820-0.845 |
| Content of: | | | | |
| Sulfur | ppm by weight | <10 | <10 | <10 |
| Nitrogen | ppm by weight | <5 | <5 | |
| Cetane Number D613 | | 55.4 | — | >51 |
| Cetane Index D4737A | | 54.4 | — | >46 |
| Aromatics | % by weight | 2 | 2 | <11 |
| Simulated Distillation D2887 | | | | |
| 0 | ° C. | 152 | 377 | |
| 5 | ° C. | 160 | 381 | |
| 10 | ° C. | 171 | 383 | |
| 30 | ° C. | 216 | 391 | |
| 50 | ° C. | 263 | 398 | |
| 70 | ° C. | 318 | 404 | |
| 90 | ° C. | 369 | 420 | |
| 95 | ° C. | 380 | 426 | |
| 100 | ° C. | 390 | 429 | |
| Distillation D86 | | | | |

TABLE 11-continued

| Characteristics of the 150-385° C. and 385° C.+ cuts, and EN-590 commercial specifications | | | | |
|---|---|---|---|---|
| Characteristics | Units | 150-385° C. Cut | 385° C.+ Cut | EN-590 Specifications |
| 0 | ° C. | 181 | 402 | |
| 5 | ° C. | 187 | 403 | |
| 10 | ° C. | 193 | 396 | |
| 30 | ° C. | 225 | 389 | |
| 50 | ° C. | 262 | 384 | |
| 70 | ° C. | 305 | 387 | |
| 90 | ° C. | 344 | 394 | |
| 95 | ° C. | 355 | 398 | <360° C. |
| 100 | ° C. | 358 | 395 | |

Table 11 shows that the 150-385° C. cut has the qualities required to be sent directly to the diesel pool.

Example 3 (not in Accordance with the Invention)

In this example, the hydrocarbon feedstock of pyrolysis oil type identical to that used in example 1 is sent directly to a steam cracking stage.

The yields by weight of the various products obtained are calculated with respect to the initial feedstock (see table 12).

TABLE 12

| Yields of the steam cracking stage | | |
|---|---|---|
| $H_2$, CO, $C_1$ | % w/w | 7.7 |
| Ethylene | % w/w | 33.1 |
| Propylene | % w/w | 18.0 |
| $C_4$ cut | % w/w | 14.4 |
| Pyrolysis gasoline | % w/w | 20.3 |
| Pyrolysis oil | % w/w | 6.5 |

The yields of ethylene and propylene, obtained after direct steam cracking of the pyrolysis oil (process not in accordance with the invention) and presented in table 12, are lower than those obtained after steam cracking of a feedstock resulting from the treatment according to the process of the invention of the same plastics pyrolysis oil of example 1 (cf. table 8), which demonstrates the advantage of the process according to the invention. Additionally, the treatment of pyrolysis oil directly in a steam cracking furnace (example 2) resulted in increased coke formation, requiring premature shutdown of the furnace.

The invention claimed is:

1. A process for the treatment of a feedstock comprising a plastics pyrolysis oil, comprising:

a) performing a selective hydrogenation stage in a reaction section fed at least with said feedstock maintained in the liquid phase and a gas stream comprising hydrogen to obtain a hydrogenated effluent, wherein said selective hydrogenation is performed in the presence of at least one selective hydrogenation catalyst, at a temperature between 100 and 250° C., at a hydrogen partial pressure between 1.0 and 10.0 MPa absolute and at an hourly space velocity between 1.0 and 10.0 $h^1$;

b) performing a hydrotreating stage in a hydrotreating reaction section employing a fixed-bed reactor having n catalytic beds, n being an integer greater than or equal to 1, each bed comprising at least one hydrotreating catalyst, said hydrotreating reaction section being fed at least with said hydrogenated effluent and a gas stream comprising hydrogen to obtain a hydrotreating effluent, wherein the hydrogenated effluent and a gas stream comprising hydrogen are fed to a first catalytic bed of said hydrotreating reaction section, and wherein said hydrotreating is performed at a temperature between 250 and 430° C., at a hydrogen partial pressure between 1.0 and 10.0 MPa absolute and at an hourly space velocity between 0.1 and 10.0 $h^1$;

c) performing a separation stage comprising feeding the hydrotreating effluent and an aqueous solution into said separation step to obtain at least one gaseous effluent, an aqueous effluent, and a hydrocarbon effluent, said separation being operated at a temperature between 50 and 370° C., wherein the separation comprises injection of the aqueous solution into the hydrotreating effluent upstream of the separation;

d) optionally a stage of fractionating all or part of the hydrocarbon effluent to obtain at least one gas stream and at least one hydrocarbon stream; and e) a recycling stage comprising recovering a recycle stream comprising a fraction of the hydrocarbon effluent resulting from the separation c) or at least a fraction of at least one of the hydrocarbon stream(s) resulting from the optional fractionation, and recycling at least a fraction of said recycle stream to the selective hydrogenation, the hydrotreating or both the selective hydrogenation and hydrotreating;

wherein an amine stream is injected upstream of the selective hydrogenation stage.

2. The process as claimed in claim 1, wherein at least one fraction of said recycle stream is fed to said hydrotreating reaction section, and wherein the at least one fraction is introduced as a mixture with said hydrogenated effluent, separately from said hydrogenated effluent or a first part of said at least one fraction of the recycle stream is introduced as a mixture with said hydrogenated effluent and a second part of said at least one fraction of the recycle stream is introduced separately from said hydrogenated effluent.

3. The process as claimed in claim 1, wherein at least one fraction of the recycle stream is fed to stage a), either as a mixture with said feedstock, separately from said feedstock, or a first part of said at least one fraction of the recycle stream is introduced as a mixture with said feedstock and a second part of said at least one fraction of the recycle stream is introduced separately from said feedstock.

4. The process as claimed in claim 1, comprising said fractionation stage d).

5. The process as claimed in claim 1, further comprising a stage a0) performing pretreatment of the feedstock comprising a plastics pyrolysis oil, said pretreatment being carried out prior to the selective hydrogenation in an adsorption section performed in the presence of at least one adsorbent, and/or in a solid/liquid separation section, and said pretreatment stage is performed at a temperature between 0 and 150° C. and at a pressure between 0.15 and 10.0 MPa absolute, to obtain a pretreated feedstock which feeds stage a).

6. The process as claimed in claim 1, in which the selective hydrogenation stage a) is performed at a temperature between 110 and 200° C.

7. The process as claimed in claim 1, in which the amount of hydrogen of the gas stream employed in stage a) is between 1 and 200 $Nm^3$ of hydrogen per $m^3$ of feedstock.

8. The process as claimed in claim 1, in which the reaction section of stage a) employs at least two reactors.

9. The process as claimed in claim 1, in which said at least one selective hydrogenation catalyst comprises a support, and a hydrodehydrogenating function comprising at least one element from Group VIII, and/or at least one element from Group VIb.

10. The process as claimed in claim 9, in which said at least one selective hydrogenation catalyst comprises less than 1% by weight of nickel, expressed as nickel oxide NiO with respect to the weight of said catalyst, and less than 5% by weight of molybdenum, expressed as molybdenum oxide $MoO_3$ with respect to the weight of said catalyst, on an alumina support.

11. The process as claimed in claim 1, in which n is between 2 and 10, and an additional gas stream comprising hydrogen is introduced into the inlet of each catalytic bed starting from the second catalytic bed of the hydrotreating reaction section of stage b).

12. The process as claimed in claim 1, in which the amount of hydrogen of the gas stream employed in stage b) is between 50 and 1000 $Nm^3$ of hydrogen per $m^3$ of fresh feedstock which feeds stage a).

13. The process as claimed in claim 1, in which said at least one hydrotreating catalyst comprises a support, and a hydrodehydrogenating function comprising at least one element from Group VIII, and/or at least one element from Group VIb.

14. The process as claimed in claim 1, in which said at least one hydrotreating catalyst exhibits a specific surface of greater than or equal to 250 $m^2/g$.

15. The process as claimed in claim 1, further comprising a steam cracking stage f) comprising contacting at least a fraction of the hydrocarbon effluent from step c) or at least a fraction of at least one of the hydrocarbon stream(s) from optional step d), wherein the steam cracking is performed in at least one pyrolysis furnace at a temperature of between 700 and 900° C. and at a gauge pressure of between 0.05 and 0.3 MPa.

16. The process as claimed in claim 1, in which the reaction section of stage a) employs at least two reactors operating in permutable mode.

17. The process as claimed in claim 1, in which said at least one selective hydrogenation catalyst comprises a support selected from the group consisting of alumina, silica, silica-aluminas, magnesia, clays and their mixtures, and a hydrodehydrogenating function comprising at least one element from Group VIII selected from the group consisting of nickel and cobalt, and/or at least one element from Group VIb selected from the group consisting of molybdenum and tungsten.

18. The process as claimed in claim 1, in which said at least one hydrotreating catalyst comprises a support selected from the group consisting of alumina, silica, silica-aluminas, magnesia, clays and their mixtures, and a hydrodehydrogenating function comprising at least one element from Group VIII selected from the group consisting of nickel and cobalt, and/or at least one element from Group VIb selected from the group consisting of molybdenum and tungsten.

19. The process as claimed in claim 1, in which said at least one hydrotreating catalyst exhibits a specific surface of 300 to 400 $m^2/g$.

20. The process as claimed in claim 1, in which the amount of hydrogen of the gas stream employed in stage a) is between 5 and 20 $Nm^3$ of hydrogen per $m^3$ of feedstock and in which the amount of hydrogen of the gas stream employed in stage b) is between 100 and 300 $Nm^3$ of hydrogen per $m^3$ of fresh feedstock which feeds stage a).

* * * * *